US005960226A

United States Patent [19]

Van Schepdael et al.

[11] Patent Number: 5,960,226

[45] Date of Patent: Sep. 28, 1999

[54] ROLLER FOR USE IN WET PROCESSING APPARATUS

[75] Inventors: Ludo Van Schepdael, Gingelom; Bart Verhoest, Wilrijk, both of Belgium

[73] Assignee: Agfa-Gevaert, Mortsel, Belgium

[21] Appl. No.: 09/046,077

[22] Filed: Mar. 23, 1998

[30] Foreign Application Priority Data

Mar. 21, 1997 [EP] European Pat. Off. ..... 97200853

[51] Int. Cl.[6] ..... G03D 3/08

[52] U.S. Cl. ..... 396/614; 396/612; 396/620; 396/622; 355/27; 355/29; 492/27; 492/56

[58] Field of Search ..... 396/612, 614, 396/620, 622; 355/27–29; 492/27, 56

[56] References Cited

U.S. PATENT DOCUMENTS 4,148,576 4/1979 Martino ..... 396/614
4,166,689 9/1979 Schausberger et al. ..... 396/614
4,594,068 6/1986 Bardutzky et al. ..... 492/56
5,313,242 5/1994 Devaney, Jr. et al. ..... 396/622

FOREIGN PATENT DOCUMENTS 0415392 3/1991 European Pat. Off. .
0744656 11/1996 European Pat. Off. .

*Primary Examiner*—D. Rutledge
*Attorney, Agent, or Firm*—Baker & Botts, L.L.P.

[57] ABSTRACT

The roller comprises a core (56) having an elastomeric covering which comprises an outer exposed region (60) and an intermediate region (58) positioned between the outer region (60) and the core (56). The outer region (60) has a thickness which decreases towards each end of the roller and the intermediate region (58) has a thickness which increases towards each end of the roller. When associated with another such roller to form a nip in an apparatus for wet processing sheet materials, carry-over is reduced, leakage when no sheet material is passing through the nip is reduced, and the risk of physical damage to the sheet material is reduced.

7 Claims, 3 Drawing Sheets

ROLLER FOR USE IN WET PROCESSING APPARATUS

FIELD OF THE INVENTION

This invention relates to the construction of a roller suitable for use in an apparatus for the wet processing of photographic sheet material, such as X-ray film, pre-sensitised plates, graphic art film and paper, and offset plates.

BACKGROUND OF INVENTION

As a rule, a processing apparatus for photographic sheet material comprises several vessels each of which contains a treatment liquid, such as a developer, a fixer and a rinse liquid. As used herein, the term "sheet material" includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

In a conventional processing apparatus the sheet material is transported along a generally horizontal feed path, the sheet material passing from one vessel to another usually via a circuitous feed path passing under the surface of each treatment liquid and over dividing walls between the vessels.

In a system for the development of aluminium lithographic printing plates of the type disclosed in EP-A-410500 (Agfa Gevaert NV), the apparatus comprises a housing with pairs of processing rollers carried on roller shafts supported within the housing. The processing rollers are positioned substantially parallel and in line contact with each other. Means are provided for feeding photographic sheet material between the rollers. The roller shafts are biased towards each other to exert a pressure on the photographic sheet material as it passes between the rollers. Processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement.

Furthermore, the sheet transport path in a vertically oriented apparatus may be substantially straight, in contrast to the circuitous feed path which is usual in a horizontally oriented apparatus. As a consequence of the straight path, the material sensitivity to scratches becomes independent of the stiffness and thickness of the material.

In a vertically oriented apparatus, it is important to avoid, or at least minimise leakage of treatment liquid from one vessel to another and carry-over as the sheet material passes through the apparatus. U.S. Pat. No. 4,166,689 (Schausberger et al. assigned to Agfa-Gevaert AG) describes such an apparatus in which liquid escapes form the lower opening and is intercepted by the tank of a sealing device with two squeegees located in the tank above a horizontal passage in line with the lower opening. One or more pairs of drive rollers in the vessel close the lower opening and also serve to transport the sheet material along a vertical path which extends between the openings of the vessel.

In both such forms of processing apparatus, the rollers are used in pairs, biased towards each other, between which the sheet material passes to act as a seal between treatment vessels of the processing apparatus, that is to remove excess treatment liquid from the sheet as it passes from one treatment vessel to the next. This reduces carry-over of treatment liquid and thereby reduces contamination and wastage. A good removal of processing liquid is also required to reduce the drying time of the sheet material after the last process bath, and hence to reduce the energy use.

It is often convenient that these rollers also act as drive rollers, serving to advance the sheet material through the apparatus. To meet these demands successfully, the resilience of the rollers is important. Usually such rollers comprise a rigid core having a layer of, for example, elastomeric material positioned over the core. If the elastomeric material is too hard, the squeegeeing properties beyond the edges of the sheet material may not be optimum, resulting in an unacceptable level of carry-over. On the other hand, if the elastomeric material is too soft it will often contain oily materials which are liable to leach out of the elastomer and contaminate the sheet material, while the elastomeric material becomes progressively degraded.

Typical rollers have a core provided with a covering of elastomeric material. As the sheet material leaves a given liquid treatment vessel it is necessary to remove any liquid carried on the sheet material as efficiently as possible, to prevent carry-over of liquid into a next treatment vessel and to reduce edge effects which arise from non-homogeneous chemistry on the sheet material after squeegeeing. This applies whether the apparatus is of a horizontal or vertical configuration. To do this job properly, the rollers must exert a sufficient and homogeneous pressure over the whole width of the sheet material. Also, to reduce edge effects, it is desirable that the opposite roller surfaces are in contact with each other beyond the edges of the sheet material. To put this problem in context, rollers used in conventional processing apparatus for example have a length of 400 mm or more and a diameter of from 24 to 60 mm. The sheet material typically has a width of from a few millimetres up to 2 m and a thickness of 0.05 mm to 0.5 mm.

In view of the nature of elastomeric material, it is in fact impossible to totally eliminate any gap between the roller surfaces at the edges of the sheet material as it passes through the nip. It is desirable that the roller surfaces be in contact with each other within as short a distance as possible from the edges of the sheet material i.e. that the size of the leak zone should be minimised. It is important however that the force between the rollers is sufficient to prevent leakage when no sheet material is passing through. However, the force must not be so high as to risk physical damage to the sheet material as it passes through the nip, such as dislocation of coatings carried on the sheet material or separation of layers in the case of laminated sheet materials. Physical damage is more likely to occur with thin (for example paper) based sheet materials rather than thick (for example aluminium or polyester) based she et materials.

OBJECTS OF INVENTION

It is an object of the invention to provide a roller for use in wet processing apparatus, which when associated with another such roller to form a nip, enables carry-over to be reduced to a low level, reduces leakage when no sheet material is passing through the nip and reduces the risk of physical damage to the sheet material.

SUMMARY OF THE INVENTION

We have discovered that this objective, and other useful benefits, can be obtained when the elastomeric covering comprises an outer exposed region and an intermediate region positioned between the outer region and the core, and the intermediate and outer regions are shaped in a specified manner.

According to the invention, there is provided a roller comprising a core having an elastomeric covering, characterised in that the elastomeric covering comprises an exposed outer region and an intermediate region positioned between the outer region and the core, the outer region having a thickness which decreases towards each end of the roller and the intermediate region having a thickness which increases towards each end of the roller.

The intermediate region and the outer region are preferably constituted by distinguishable intermediate and outer layers, the outer region being formed of a material having a Shore-A hardness higher than that of the intermediate region. The difference between the Shore-A hardness of the intermediate layer and the outer layer being at preferably at least 5. Alternatively, the intermediate and outer regions are continuous, the Shore-a hardness varying through the thickness of the covering, being higher towards the outside of the roller.

Preferably, the roller comprises a rigid core, the intermediate region being positioned immediately over the core, i.e. directly in contact with the core and with the outer region.

The total thickness of the outer and intermediate regions may be constant along the length of the roller. When the core has a constant diameter along its length, this provision results in the roller having a constant diameter along its length. However, it is more preferred that the outer diameter of the outer region varies along the length of the roller, in particular the outer diameter of the outer region decreases towards each end of the roller. For example, the outer diameter of the roller at its centre may be up to 10%, but preferably not more than 2%, higher than at its ends. This construction has the advantage that where the force between the rollers of a roller pair is applied at the ends of the rollers, a more even force is applied across the width of the sheet material as it passes through the nip. That is, the change in pressure ($\Delta p$) across the width of the nip should ideally be close to zero.

In an alternative construction, the $\Delta p=0$ condition may be approached with a roller of constant diameter, by forming the covering of a material whose properties, in particular the $E_{mod}$ thereof, vary along the length of the roller. In this embodiment, the change in roller surface velocity ($\Delta v$) across the width of the nip will also approach zero, leading to a condition where wrinkling of the sheet material is reduced. However, it is preferred that, if the $\Delta v=0$ condition cannot be met (for example for tolerance reasons), then $\Delta v$ should be higher towards the ends of the roller, to achieve a sheet centering effect.

The core may be formed of a material selected from stainless steel, non-ferrous alloys, titanium, aluminium or a composite thereof. The core will usually be rigid. Usually the core will be formed of a material having uniform properties, in particular its $E_{mod}$, along its length.

The outer region may be constituted by a distinguishable outer layer having a minimum thickness of, for example, at least 0.2 mm, which may be from 1% to 10% of the overall roller diameter. The outer region may be formed of an elastomeric material selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber and, particularly for the outer region, and such materials doped with a surface modifying material selected from PTFE (poly tetra fluoro ethylene) particles, carbon fibres, glass fibres, glass beads and mixtures thereof. The Shore-A hardness of the outer region may be more than 25, such as from 40 to 90.

The intermediate region may be constituted by a distinguishable outer layer having a minimum thickness of, for example, at least 1.0 mm, which may be from 5% to 35% of the overall roller diameter. The intermediate region may be formed of an elastomeric material selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrile-butyl rubber. The Shore-A hardness of the intermediate region may be more than 50, such as from 15 to 45.

The invention also provides an apparatus for the wet processing of sheet material, the apparatus including means defining a sheet material path through the apparatus and at least one pair of rollers biased into contact with each other to form a nip through which the sheet material path extends, at least one roller of the pair being as defined above.

DETAILED DESCRIPTION OF THE INVENTION

Figure 1:
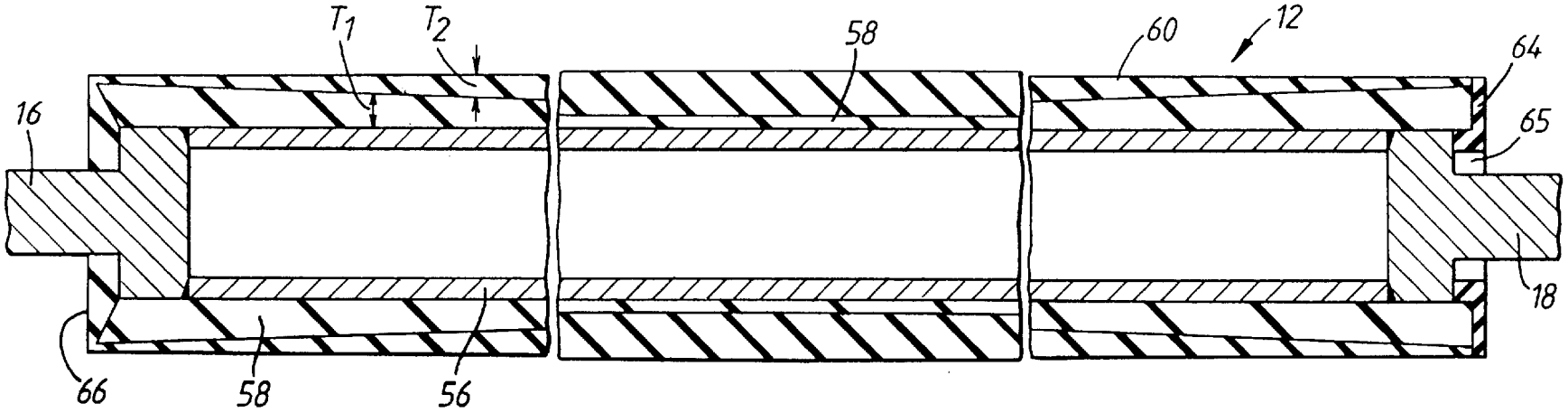
Figure 2:
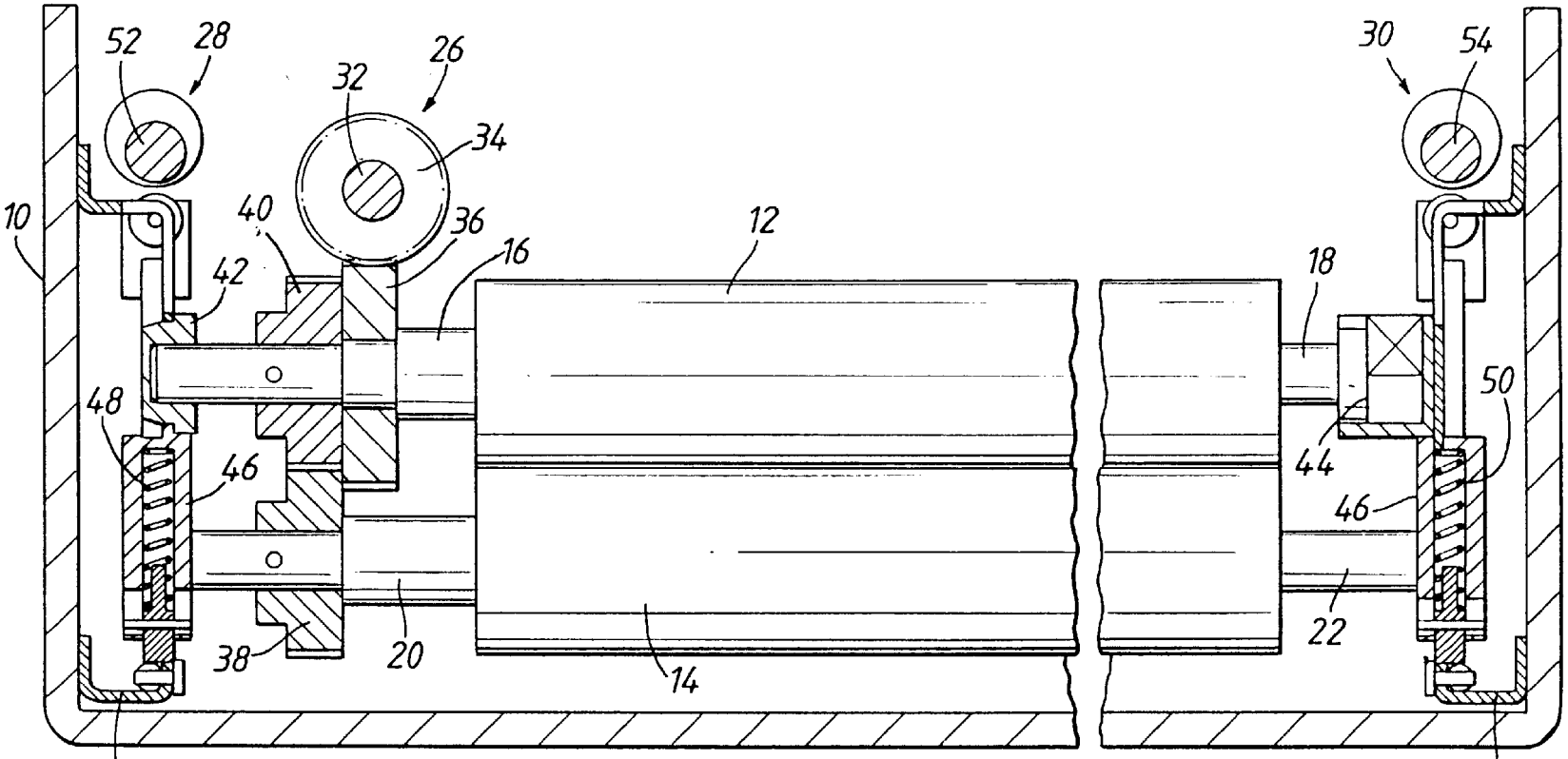
Figure 3:
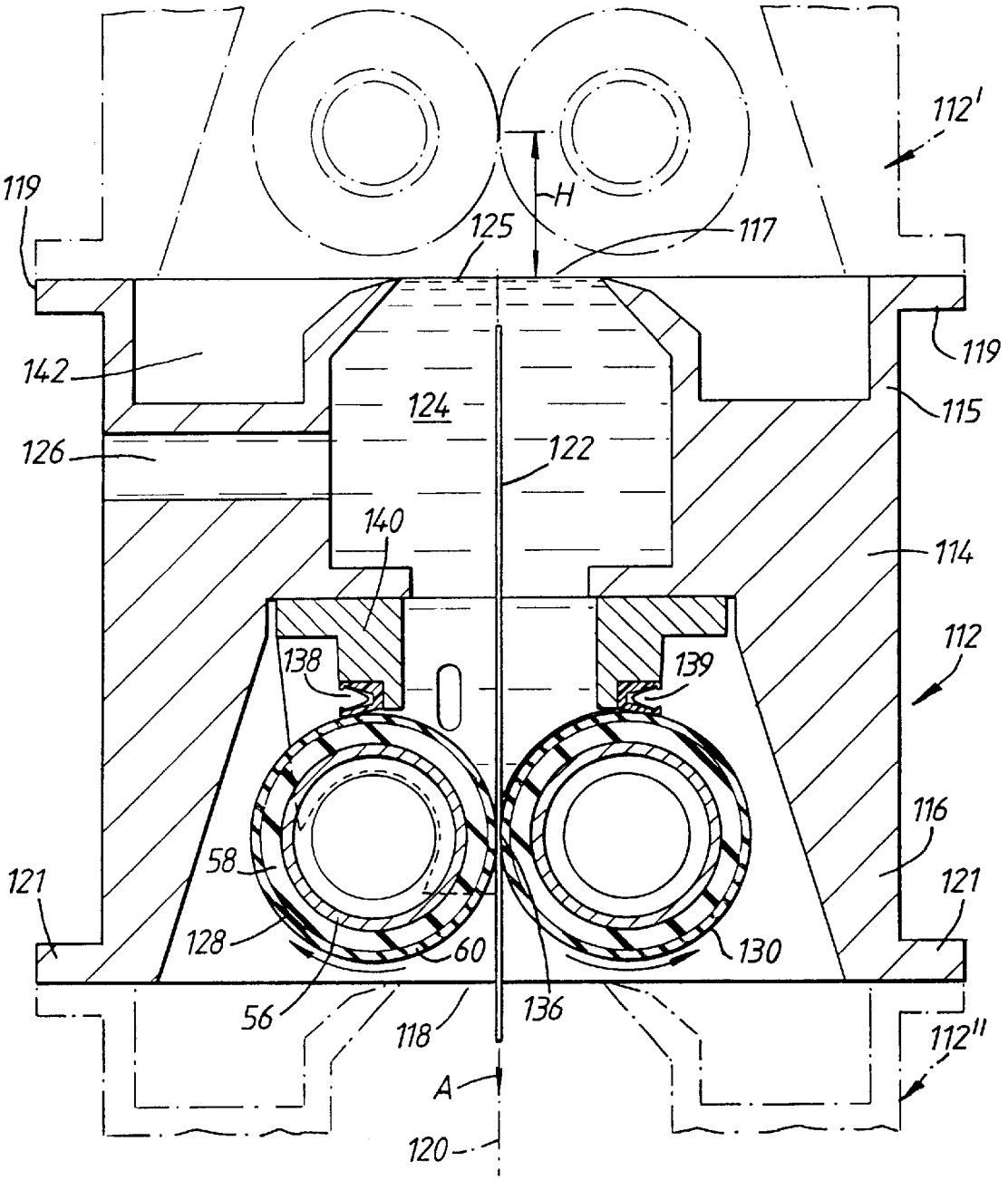

The invention will be described by the following illustrative embodiments with reference to the accompanying drawings without the intention to limit the invention thereto, and in which: FIG. 1 is a cross-sectional view of a processing roller suitable for use in a horizontal photographic material processing apparatus;

FIG. 2 is an elevational view of part of a horizontal photographic material processing apparatus according to the present invention, using processing rollers as shown in FIG. 1; and FIG. 3 is, in solid lines, a cross-sectional view of one vessel of a vertical processing apparatus according to the invention, with adjacent vessels being partly shown in broken lines.

Referring to FIG. 1, which is not drawn to scale, a roller 12 comprises a stainless steel rigid core 56, an inner or intermediate layer of elastomeric material 58 positioned over the core, and an outer layer of elastomeric material 60 positioned over the intermediate layer. No other layers are present, so that the intermediate layer 58 is directly in contact with the core and with the outer layer 60. The roller covering has a length of 800 mm.

The intermediate layer 58 has a variable thickness $T_1$ which varies along its length, from 6.50 mm at each end of the roller to 3.66 mm at the centre of the roller. The intermediate layer is formed of EPDM having a Shore-A hardness of 25±5.

The outer layer 60 is also formed of EPDM, but in this case the Shore-A hardness is 50±5. The outer layer has a variable thickness $T_2$ which varies from 0.92 mm at each end of the roller to 3.84 mm at the centre of the roller. The roller core has a constant diameter of 25 mm. The roller therefore has a slightly convex outer diameter varying from 39.84 mm at each end to 40.00 mm at its centre.

The thicknesses of the intermediate and outer layers, and the total elastomeric covering thickness ($T_1$+$T_2$), as a function of the distance 1 along the roller from one end, are set out in the following table (all dimensions in mm).

| distance 1 | intermediate thickness $T_1$ | outer thickness $T_2$ | total thickness $T_1 + T_2$ |
|---|---|---|---|
| 0 | 6.50 | 0.92 | 7.42 |
| 44 | 5.76 | 1.68 | 7.44 |
| 133 | 5.02 | 2.44 | 7.46 |
| 222 | 4.20 | 3.28 | 7.48 |
| 311 | 3.77 | 3.73 | 7.50 |
| 400 | 3.66 | 3.84 | 7.50 |
| 489 | 3.77 | 3.73 | 7.50 |
| 578 | 4.20 | 3.28 | 7.48 |
| 667 | 5.02 | 2.44 | 7.46 |
| 756 | 5.76 | 1.68 | 7.44 |
| 800 | 6.50 | 0.92 | 7.42 |

To form the roller shown in FIG. 1, the intermediate layer 58 is formed over the rigid core by coating an adhesive primer on the core and then applying non-vulcanised EPDM thereto. A plastic tape is then tightly applied over the EPDM to squeeze out any excess air. The assembly is placed in an autoclave at a pressure of 6 to 7 bar and at a temperature of 160 to 180° C. for 1 to 2 hours in the presence of sulphur or a peroxide, to ensure vulcanisation. After removing the assembly from the autoclave and cooling, the intermediate layer 58 is ground to the desired profile. Thereafter, the outer layer 60 is formed by a similar process, followed by machining to ensure the desired profile.

FIG. 1 illustrates two possible embodiments of the invention. As shown at the right hand end of FIG. 1, a separate portion 64 of the outer layer extends over the end face of the inner layer 58. This construction is particularly suitable when the outer layer is formed of EPDM, the end part 64 including PTFE as a friction reducing component to reduce the friction between the roller and the sealing surface of the apparatus. The portion 64 is so shaped as to provide a space 65 into which the elastomeric material of the covering may be deformed as a result of a sealing force between the roller and a sealing surface of the apparatus. In this embodiment, the outer layer is thus formed in two parts, namely a part 60 which extends along the outer surface of the roller and another part 64 which extends over the end face of the inner layer 58. The two parts of the outer layer may be formed by separate vulcanisation steps.

In the embodiment shown at the left hand end of FIG. 1, the outer region 60 itself extends over the end face of the inner layer 58. This construction is particularly suitable when the outer layer of elastomeric material is formed of polyurethane.

In both these embodiments, shafts 16, 18 are suitably welded to the end of the core 56, or are integral therewith.

Whatever construction is used for the ends of the roller, it is advantageous to mask the intermediate layer 58 from processing liquids used in the apparatus in which the roller is incorporated, so as to reduce chemical attack on the more chemically sensitive material of the intermediate layer.

Referring to FIG. 2, part of a photographic sheet material processing apparatus, of the type described in EP-A-410500 referred to above, is shown. The processing apparatus is mounted within a generally rectangular housing 10 which may include a rectangular metal mainframe (not shown in FIG. 2 for the sake of clarity) for supporting the various sections of the apparatus. The apparatus includes a number of treatment vessels, sheet material to be processed being passed from one vessel to the next by squeegee roller pairs, which also serve as drive rollers. One such roller pair is shown in FIG. 2, namely an upper squeegee roller 12 and a lower squeegee roller 14. The upper roller 12 is constructed as shown in FIG. 1. The Lower roller 14 is similarly constructed. The rollers 12 and 14 are positioned substantially parallel and in line contact with each other. The upper roller 12 is fixed on respective shafts 16 and 18 for rotation and the lower roller 14 is fixed on respective shafts 20 and 22 for rotation. The roller shafts 16, 18, 20, 22 are mounted at each end in bearings held in respective sub-frames 24.

A drive device 26 for the rollers comprises a mechanical transmission for driving said processing roller 12 and a set of co-operating gears located at one end and at the same side of both roller shafts 16, 20. The upper processing roller 12 is driven at one end thereof through a worm-screw 34 and a worm-wheel 36 by a drive shaft 32, which links all upper rollers in the apparatus. The lower processing roller 14 is driven by a helical gear 38 which meshes with another helical gear 40. The drive shaft 32 is driven preferably by an electric motor with an encoding disc system (not shown) in order to control the speed and the progressing horizontal position of the sheet material.

The coordinates of the upper processing roller 12 are defined by the end bearings 42 and 44. The lower roller 14 rotates in two bearing plates 46 which slide vertically in guides (not shown) in the sub-frames 24 so that the lower roller 14 is free to move towards and away from the upper roller 12.

The roller shafts are biased towards each other to exert a pressure on the photographic sheet material as it passes between the rollers. Compression springs 48, 50 bias the lower roller 14 towards the upper roller 12 by a force of up to 400 N applied at a distance of about 850 mm.

The profile of roller 12 is such that, where the lower roller 14 is similarly constructed and a biasing force of 380N/850 mm is applied by the springs 48 and 50, the force applied by the rollers to an aluminium lithographic sheet material having a thickness of 0.1 to 0.4 mm passing between the rollers is substantially even over the width thereof.

A roller displacement device generally indicated by reference 28 and 30 is also shown. The camshafts 52, 54 are each driven by a synchronised electric motor with an encoding disc system (not shown) in order to control the vertical displacement of the displaceable processing roller 14.

The rollers illustrated in FIG. 1 are also suitable for use in a vertical processing apparatus, one embodiment of which is shown in FIG. 3.

As shown in FIG. 3, each vessel 112 comprises a housing 114 which is of generally rectangular cross-section and is so shaped as to provide an upper part 115 having an upper opening 117 and a lower part 116 having a lower opening 118. The upper opening 117 constitutes a sheet material inlet and the lower opening 118 constitutes a sheet material outlet. The inlet and outlet define there-between a substantially vertical sheet material path 120 through the vessel 112, the sheet material 122 moving in a downwards direction as indicated by the arrow A. The sheet material preferably has a width which is at least 10 mm smaller than the length of the nip, so as to enable a spacing of at least 5 mm between the edges of the sheet and the adjacent limit of the nip, thereby to minimise leakage. Each vessel 112 may contain treatment liquid 124, a passage 126 in the housing 114 being provided as an inlet for the treatment liquid 124. The lower opening 118 is closed by a pair of rotatable rollers 128, 130 carried in the apparatus.

Each roller 128, 130 is of the squeegee type as illustrated in FIG. 1, comprising a stainless steel hollow core 56 carrying inner and outer elastomeric coverings 58, 60. The rollers 128, 130 are biased towards each other with a force sufficient to effect a liquid tight seal but without causing damage to the photographic sheet material 122 as it passes there-between. The line of contact between the rollers 128, 130 defines a nip 136. The rollers 128, 130 are coupled to drive means (not shown) so as to constitute drive rollers for driving the sheet material 122 along the sheet material path 120.

In the illustrated embodiment, each roller 128, 130 is in sealing contact along its length, with a respective stationary sealing member 138, 139 carried on a sealing support 140, which in turn is secured to the housing 114 of the vessel 112, the treatment liquid 124 being retained in the vessel 112 by the rollers 128, 130 and the sealing members 138, 139. The sealing members 138, 139 are formed of PTFE and have a composite structure. The sealing members 138, 139 are secured to the sealing support 140 by a suitable, water- and chemical-resistant adhesive, such as a silicone adhesive. By the use of a material of relatively high hardness for the outer layer 60 of the rollers, the wear resistance between the surface of the rollers and the sealing members 138, 139 is reduced The upper and lower housing parts 115, 116 are provided with flanges 119, 121 respectively to enable the vessel 112 to be mounted directly above or below an identical or similar other vessel 112', 112", as partly indicated in broken lines in FIG. 3. The upper housing part 115 is so shaped in relation to the lower housing part 116 as to provide a substantially closed connection between adjacent vessels. Thus, treatment liquid from vessel 112 is prevented from falling into the lower vessel 112" by the rollers 128, 130 and sealing members 138, 139, while vapours from the lower vessel 112" are prevented from entering the vessel 112 or escaping into the environment. This construction has the advantage that the treatment liquid in one vessel 112 is not contaminated by contents of the adjacent vessels and that by virtue of the treatment liquids being in a closed system evaporation, oxidation and carbonisation thereof is significantly reduced.

The upper part 115 of the housing 114 is so shaped as to define a leakage tray 142. Any treatment liquid which may pass through the roller nip of the next higher vessel 112', in particular as the sheet material 122 passes therethrough, drips from the rollers of that vessel and falls into the leakage tray 142 from where it may be recovered and recirculated as desired. The distance H between the surface 125 of the liquid 124 and the nip of the rollers of the next upper vessel 112' is as low as possible.

Reference Number List

| | |
|---|---|
| roller 12 | springs 48 and 50 |
| core 56 | roller displacement device 28, 30 |
| intermediate layer 58 | camshafts 52, 54 |
| outer layer 60 | vessel 112 |
| intermediate layer thickness $T_1$ | housing 114 |
| outer layer thickness $T_2$ | upper part 115 |
| separate portion 64 | upper opening 117 |
| space 65 | lower part 116 |
| shafts 16, 18 | lower opening 118 |
| housing 10 | path 120 |
| upper squeegee roller 12 | sheet material 122 |
| lower squeegee roller 14 | liquid 124 |
| shafts 20 and 22 | passage 126 |
| sub-frames 24 | rollers 128, 130 |
| drive device 26 | sealing member 138, 139 |
| worm-screw 34 | sealing support 140 |
| worm-wheel 36 | flanges 119, 121 |
| helical gear 38 | other vessel 112', 112" |
| helical gear 40 | leakage tray 142 |
| drive shaft 32 | surface 125 |
| bearing plates 46 | |
| Compression springs 48, 50 | |

We claim:

1. A roller comprising a core (56) having an elastomeric covering, characterised in that said elastomeric covering comprises an exposed outer region (60) and an intermediate region (58) positioned between the outer region (60) and the core (56), the outer region (60) having a thickness which decreases towards each end of the roller and the intermediate region (58) having a thickness which increases towards each end of the roller.

2. A roller according to claim 1, wherein the outer diameter of the outer region (60) varies along the length of the roller.

3. A roller according to claim 2, wherein the outer diameter of said outer region (60) decreases towards each end of the roller.

4. A roller according to claim 1, comprising a rigid core (56), said intermediate region (58) being positioned immediately over said core (56) directly in contact therewith and with said outer region (60).

5. A roller according to claim 1, wherein said intermediate region (58) and said outer region (60) are constituted by distinguishable intermediate and outer layers.

6. A roller according to claim 1, wherein said outer region (60) is formed of a material having a Shore-A hardness higher than that of said intermediate region (58).

7. An apparatus for the wet processing of sheet material, the apparatus including means (117, 118) defining a sheet material path (120) through the apparatus and at least one pair of rollers (128, 130) biased into contact with each other to form a nip (136) through which said sheet material path extends, at least one roller of said pair being according to any preceding claim.

* * * * *